US010689915B2

(12) United States Patent
Do et al.

(10) Patent No.: US 10,689,915 B2
(45) Date of Patent: Jun. 23, 2020

(54) EARTH-BORING TOOLS INCLUDING MOVABLE FORMATION-ENGAGING STRUCTURES

(71) Applicant: Baker Hughes, a GE company, LLC, Houston, TX (US)

(72) Inventors: Eric Do, The Woodlands, TX (US); Juan Miguel Bilen, The Woodlands, TX (US); Philip Christof Schulte, Burgwedel (DE); Jason E. Hoines, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/740,126

(22) Filed: Jan. 10, 2020

(65) Prior Publication Data

US 2020/0149351 A1 May 14, 2020

Related U.S. Application Data

(60) Division of application No. 16/408,087, filed on May 9, 2019, now Pat. No. 10,570,666, which is a division (Continued)

(51) Int. Cl.

| | |
|---|---|
| ***E21B 10/43*** | (2006.01) |
| ***E21B 10/62*** | (2006.01) |
| *E21B 10/42* | (2006.01) |

(52) U.S. Cl.

CPC ..... *E21B 10/43* (2013.01); *E21B 10/62* (2013.01); *E21B 10/42* (2013.01); *Y10T 29/49826* (2015.01)

(58) Field of Classification Search

CPC ..... E21B 10/42; E21B 10/62; E21B 10/46; E21B 10/43; E21B 10/567; E21B 10/55

See application file for complete search history.

(56) References Cited

U.S. PATENT DOCUMENTS

| | | | |
|---|---|---|---|
| 1,029,491 | A | 6/1912 | Cortinas |
| 2,877,988 | A | 3/1959 | Cameron et al. |

(Continued)

FOREIGN PATENT DOCUMENTS

| | | | |
|---|---|---|---|
| GB | 2319046 | A | 5/1998 |
| GB | 2357101 | A | 6/2001 |

(Continued)

OTHER PUBLICATIONS

Rasheed et al., SPE 92623, Reducing Risk and Cost in Diverse Well Construction Applications: Eccentric Device Drills Concentric Hole and Offers a Viable Alternative to Underreaamers; SPE/IADC Drilling Conference, Feb. 23-25, 2005, Amsterdam, Netherlands, 23 pages.

*Primary Examiner* — Kristyn A Hall
(74) *Attorney, Agent, or Firm* — TraskBritt

(57) ABSTRACT

Earth-boring tools may have a body, a cutting element attached to the body at a first location, and a formation-engaging structure attached to the body at a second location. The formation-engaging structure may be movable during a drilling operation between a first position and a second position. In the first position, the formation-engaging structure may be located rotationally behind the cutting element at a first radial distance from a longitudinal axis of the body at which the cutting element will at least initially shield the formation-engaging structure from engaging a formation. In the second position, the formation-engaging structure may be located at a different second radial distance from the longitudinal axis of the body at which the formation-engaging structure will engage a formation.

20 Claims, 10 Drawing Sheets

Related U.S. Application Data of application No. 15/696,941, filed on Sep. 6, 2017, now Pat. No. 10,358,873, which is a continuation of application No. 13/892,745, filed on May 13, 2013, now Pat. No. 9,759,014.

(56) References Cited

U.S. PATENT DOCUMENTS

| | | | |
|---|---|---|---|
| 3,847,236 | A | 11/1974 | Coalson |
| 4,403,664 | A | 9/1983 | Sullinger |
| 4,413,682 | A | 11/1983 | Callihan et al. |
| 4,548,282 | A | 10/1985 | Hurtz et al. |
| 4,654,947 | A | 4/1987 | Davis |
| 4,690,228 | A | 9/1987 | Voelz et al. |
| 4,782,903 | A | 11/1988 | Strange |
| 5,060,736 | A | 10/1991 | Neff |
| 5,103,919 | A | 4/1992 | Warren et al. |
| 5,220,963 | A | 6/1993 | Patton |
| 5,307,886 | A | 5/1994 | Hopper |
| 5,394,951 | A | 3/1995 | Pringle et al. |
| 5,603,386 | A | 2/1997 | Webster |
| 5,787,999 | A | 8/1998 | Holte |
| 5,899,268 | A | 5/1999 | Lynde et al. |
| 6,000,479 | A | 12/1999 | Ambs |
| 6,059,051 | A | 5/2000 | Jewkes et al. |
| 6,109,372 | A | 8/2000 | Dorel et al. |
| 6,142,250 | A | 11/2000 | Griffin et al. |
| 6,419,033 | B1 | 7/2002 | Hahn et al. |
| 6,427,783 | B2 | 8/2002 | Krueger et al. |
| 6,513,606 | B1 | 2/2003 | Krueger |
| 6,609,579 | B2 | 8/2003 | Krueger et al. |
| 6,629,570 | B1 | 10/2003 | Head |
| 6,668,949 | B1 | 12/2003 | Rives |
| 6,679,328 | B2 | 1/2004 | Davis et al. |
| 6,705,413 | B1 | 3/2004 | Tessari |
| 6,848,518 | B2 | 2/2005 | Chen et al. |
| 6,920,944 | B2 | 7/2005 | Eppink et al. |
| 6,971,459 | B2 | 12/2005 | Raney |
| 7,096,978 | B2 | 8/2006 | Dykstra et al. |
| 7,287,604 | B2 | 10/2007 | Aronstam et al. |
| 7,303,022 | B2 | 12/2007 | Tilton et al. |
| 7,306,056 | B2 | 12/2007 | Ballantyne et al. |
| 7,392,857 | B1 | 7/2008 | Hall et al. |
| 7,395,882 | B2 | 7/2008 | Oldham et al. |
| 7,419,016 | B2 | 9/2008 | Hall et al. |
| 7,424,922 | B2 | 9/2008 | Hall et al. |
| 7,533,737 | B2 | 5/2009 | Hall et al. |
| 7,571,780 | B2 | 8/2009 | Hall et al. |
| 7,641,002 | B2 | 1/2010 | Hall et al. |
| 7,730,975 | B2 | 6/2010 | Hall et al. |
| 7,762,359 | B1 | 7/2010 | Miess |
| 7,845,436 | B2 | 12/2010 | Cooley et al. |
| 7,849,939 | B2 | 12/2010 | Downton et al. |
| 7,987,931 | B2 | 8/2011 | Cooley et al. |
| 8,011,456 | B2 | 9/2011 | Sherwood, Jr. |
| 8,061,455 | B2 | 11/2011 | Beuershausen |
| 8,079,431 | B1 | 12/2011 | Cooley et al. |
| 8,087,479 | B2 | 1/2012 | Kulkarni et al. |
| 8,281,882 | B2 | 10/2012 | Hall et al. |
| 8,479,845 | B1 | 7/2013 | Qian et al. |
| 8,511,946 | B2 | 8/2013 | Woodruff et al. |
| 8,881,848 | B2 | 11/2014 | Knull et al. |
| 8,950,517 | B2 | 2/2015 | Hall et al. |
| 9,103,175 | B2 | 8/2015 | Schwefe |
| 9,140,074 | B2 | 9/2015 | Schwefe et al. |
| 9,181,756 | B2 | 11/2015 | Schwefe et al. |
| 9,255,449 | B2 | 2/2016 | Schwefe et al. |
| 9,255,450 | B2 | 2/2016 | Jain et al. |
| 9,267,329 | B2 | 2/2016 | Bilen |
| 9,279,293 | B2 | 3/2016 | Izbinski |
| 9,359,826 | B2 | 6/2016 | Do et al. |
| 9,399,892 | B2 | 7/2016 | Do et al. |
| 9,663,995 | B2 | 5/2017 | Jain |
| 9,708,859 | B2 | 7/2017 | Jain et al. |
| 9,759,014 | B2 | 9/2017 | Do et al. |
| 9,915,138 | B2 | 3/2018 | Schwefe et al. |
| 10,001,005 | B2 | 6/2018 | Schwefe et al. |
| 2001/0042643 | A1 | 11/2001 | Krueger et al. |
| 2003/0051881 | A1 | 3/2003 | Vinegar et al. |
| 2003/0079913 | A1 | 5/2003 | Eppink et al. |
| 2004/0050589 | A1 | 3/2004 | Head |
| 2004/0134687 | A1 | 7/2004 | Radford et al. |
| 2004/0149431 | A1 | 8/2004 | Wylie et al. |
| 2005/0056463 | A1 | 3/2005 | Aronstam et al. |
| 2005/0126826 | A1 | 6/2005 | Moriarty et al. |
| 2005/0139393 | A1 | 6/2005 | Maurer et al. |
| 2005/0211470 | A1 | 9/2005 | Jeffryes |
| 2006/0124354 | A1 | 6/2006 | Witte |
| 2007/0079991 | A1 | 4/2007 | Cooley et al. |
| 2007/0205022 | A1 | 9/2007 | Treviranus et al. |
| 2008/0017419 | A1 | 1/2008 | Cooley et al. |
| 2008/0251293 | A1 | 10/2008 | Mumma et al. |
| 2009/0020339 | A1 | 1/2009 | Sherwood, Jr. |
| 2009/0324348 | A1 | 12/2009 | Cooley et al. |
| 2010/0071956 | A1 | 3/2010 | Beuershausen |
| 2010/0139981 | A1 | 6/2010 | Meister et al. |
| 2010/0212964 | A1 | 8/2010 | Beuershausen |
| 2011/0031029 | A1 | 2/2011 | Gavia et al. |
| 2013/0180784 | A1 | 7/2013 | Esko et al. |
| 2013/0292185 | A1 | 11/2013 | Knull et al. |
| 2014/0318873 | A1 | 10/2014 | Patel et al. |
| 2014/0332271 | A1 | 11/2014 | Do et al. |
| 2014/0332283 | A1 | 11/2014 | Do et al. |
| 2018/0179826 | A9 | 6/2018 | Jain et al. |

FOREIGN PATENT DOCUMENTS

| | | | |
|---|---|---|---|
| GB | 2344607 | B | 2/2003 |
| GB | 2401384 | A | 11/2004 |
| WO | 2004/097163 | A1 | 11/2004 |
| WO | 2006/112763 | A1 | 10/2006 |
| WO | 2013/085869 | A1 | 6/2013 |

EARTH-BORING TOOLS INCLUDING MOVABLE FORMATION-ENGAGING STRUCTURES

CROSS-REFERENCE TO RELATED APPLICATIONS

This application is a divisional of U.S. patent application Ser. No. 16/408,087, filed May 9, 2019, now U.S. Pat. No. 10,570,666, issued Feb. 25, 2020, which is a divisional of U.S. patent application Ser. No. 15/696,941, filed Sep. 6, 2017, now U.S. Pat. No. 10,358,873, issued Jul. 23, 2019, which is a continuation of U.S. patent application Ser. No. 13/892,745, filed May 13, 2013, now U.S. Pat. No. 9,759,014, issued Sep. 12, 2017, the disclosure of each of which is incorporated herein in its entirety by this reference.

The subject matter of this application is related to the subject matter of U.S. patent application Ser. No. 13/892,766, filed May 13, 2013, now U.S. Pat. No. 9,399,892, issued Jul. 26, 2016, for "EARTH-BORING TOOLS INCLUDING MOVABLE CUTTING ELEMENTS AND RELATED METHODS," the disclosure of which is incorporated herein in its entirety by this reference.

TECHNICAL FIELD

Embodiments of the disclosure relate to earth-boring tools having movable formation-engaging structures, and to methods of making and using such earth-boring tools.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutters are fixed in place when used to cut formation materials. A conventional fixed-cutter earth-boring rotary drill bit includes a bit body having generally radially projecting and longitudinally extending blades.

A plurality of cutting elements is positioned on each of the blades. Generally, the cutting elements have either a disk shape or, in some instances, a more elongated, substantially cylindrical shape. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements or cutters. The plurality of PDC cutting elements may be fixed within cutting element pockets formed in rotationally leading surfaces of each of the blades. Conventionally, a bonding material such as an adhesive or, more typically, a braze alloy may be used to secure the cutting elements to the bit body.

Some earth-boring tools may also include backup cutting elements, bearing elements, or both. Backup cutting elements are conventionally fixed to blades rotationally following leading cutting elements. The backup cutting elements may be located entirely behind associated leading cutting elements or may be laterally exposed beyond a side of a leading cutting element, longitudinally exposed above a leading cutting element, or both. As the leading cutting elements are worn away, the backup cutting elements may be exposed to a greater extent and engage with (e.g., remove by shearing cutting action) an earth formation. Similarly, some bearing elements have been fixed to blades rotationally following leading cutting elements. The bearing elements conventionally are located entirely behind associated leading cutting elements to limit depth-of-cut (DOC) as the bearing elements contact and ride on an underlying earth formation.

During drilling operations, the drill bit is positioned at the bottom of a well borehole and rotated.

BRIEF SUMMARY

In some embodiments, the present disclosure includes an earth-boring tool having a body, a cutting element attached to the body at a first location, and a formation-engaging structure attached to the body at a second location. The formation-engaging structure is movable during a drilling operation between a first position and a second position. In the first position, the formation-engaging structure is located rotationally behind the cutting element at a first radial distance from a longitudinal axis of the body at which the cutting element will at least initially shield the formation-engaging structure from engaging a formation. In the second position, the formation-engaging structure is located at a different second radial distance from the longitudinal axis of the body at which the formation-engaging structure will engage a formation.

Additional embodiments of the present disclosure include methods of manufacturing earth-boring tools as described herein. For example, in some embodiments, the present disclosure includes a method of forming an earth-boring tool in which a cutting element is attached to a body at a first location, and a movable formation-engaging structure is attached to the body at a second location. The movable formation-engaging structure is movable during a drilling operation between a first position and a second position. In the first position, the formation-engaging structure is located rotationally behind the cutting element at a first radial distance from a longitudinal axis of the body at which the cutting element will at least initially shield the formation-engaging structure from engaging a formation. In the second position, the formation-engaging structure is located at a different second radial distance from the longitudinal axis of the body at which the formation-engaging structure will engage a formation.

In yet further embodiments, the present disclosure includes methods of using earth-boring tools as described herein. For example, in some embodiments, the present disclosure includes a method of drilling a wellbore using an earth-boring tool. A first section of a wellbore may be drilled in a formation using an earth-boring tool that includes a cutting element attached to a body of the earth-boring tool at a first location, and a movable formation-engaging structure attached to the body at a second location, while the movable formation-engaging structure is in a first position. In the first position, the formation-engaging structure is located rotationally behind the cutting element at a first radial distance from a longitudinal axis of the body, and the cutting element at least initially shields the formation-engaging structure from engagement with the formation. The formation-engaging structure may be moved from the first position to a second position. In the second position, the formation-engaging structure is located at a different second radial distance from the longitudinal axis of the body and engages the formation. A second section of the wellbore then may be drilled in the formation using the earth-boring tool while the formation-engaging structure is in the second position and engages the formation.

BRIEF DESCRIPTION OF THE DRAWINGS

While the specification concludes with claims particularly pointing out and distinctly claiming what are regarded as embodiments of the present invention, advantages of the embodiments may be more readily ascertained from the following description of certain example embodiments when read in conjunction with the accompanying drawings in which:

DETAILED DESCRIPTION

The illustrations presented herein are not actual views of any particular earth-boring tool or component thereof, but are merely idealized representations that are employed to describe embodiments of the present disclosure. Additionally, elements common between figures may retain the same numerical designation.

Figure 1:
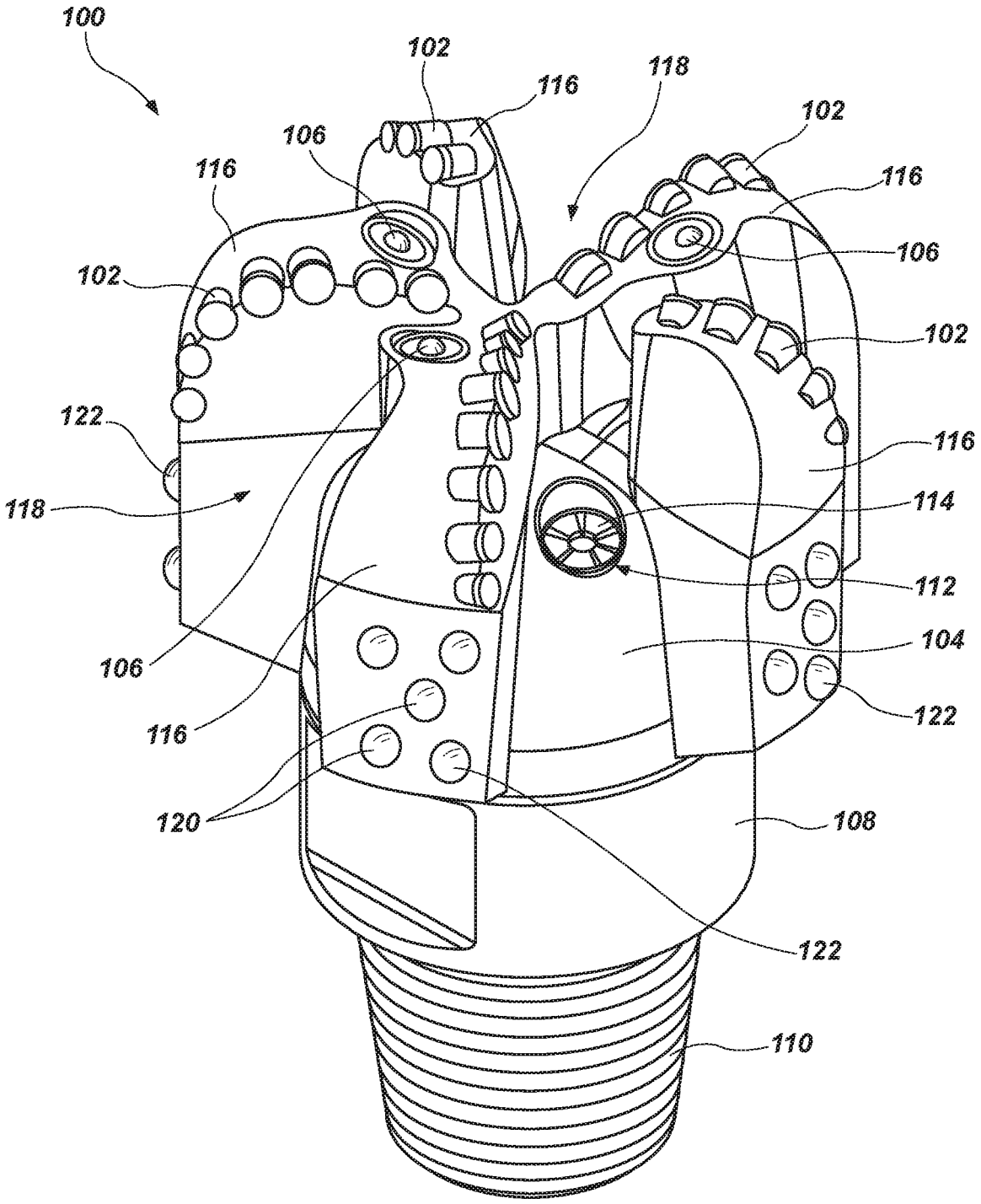
FIG. 1 is a perspective view of an earth-boring tool of the present disclosure.

FIG. 1 is a perspective view of an embodiment of an earth-boring tool 100 of the present disclosure. The earth-boring tool 100 of FIG. 1 is configured as an earth-boring rotary drill bit. The earth-boring tool 100 more specifically comprises a drag bit having a plurality of cutting elements 102 mounted at fixed locations on a body 104 of the earth-boring tool 100. The earth-boring tool 100 also includes one or more movable formation-engaging structures 106 that are also attached to the body 104. The movable formation-engaging structures 106 may comprise, for example, cutting elements or bearing elements and may be moved from one position to another position during a drilling operation, as discussed in further detail below.

The body 104 of the earth-boring tool 100 may be secured to a shank 108 having a threaded connection portion 110, which may conform to industry standards, such as those promulgated by the American Petroleum Institute (API), for attaching the earth-boring tool 100 to a drill string.

The body 104 may include internal fluid passageways that extend between fluid ports 112 at the face of the body 104 and a longitudinal bore that extends through the shank 108 and partially through the body 104. Nozzle inserts 114 may be secured within the fluid ports 112 of the internal fluid passageways. The body 104 may further include a plurality of blades 116 that are separated by what are referred to in the art as "junk slots" 118. In some embodiments, the body 104 may include gage wear plugs 120, wear knots 122, or both.

Figure 2:
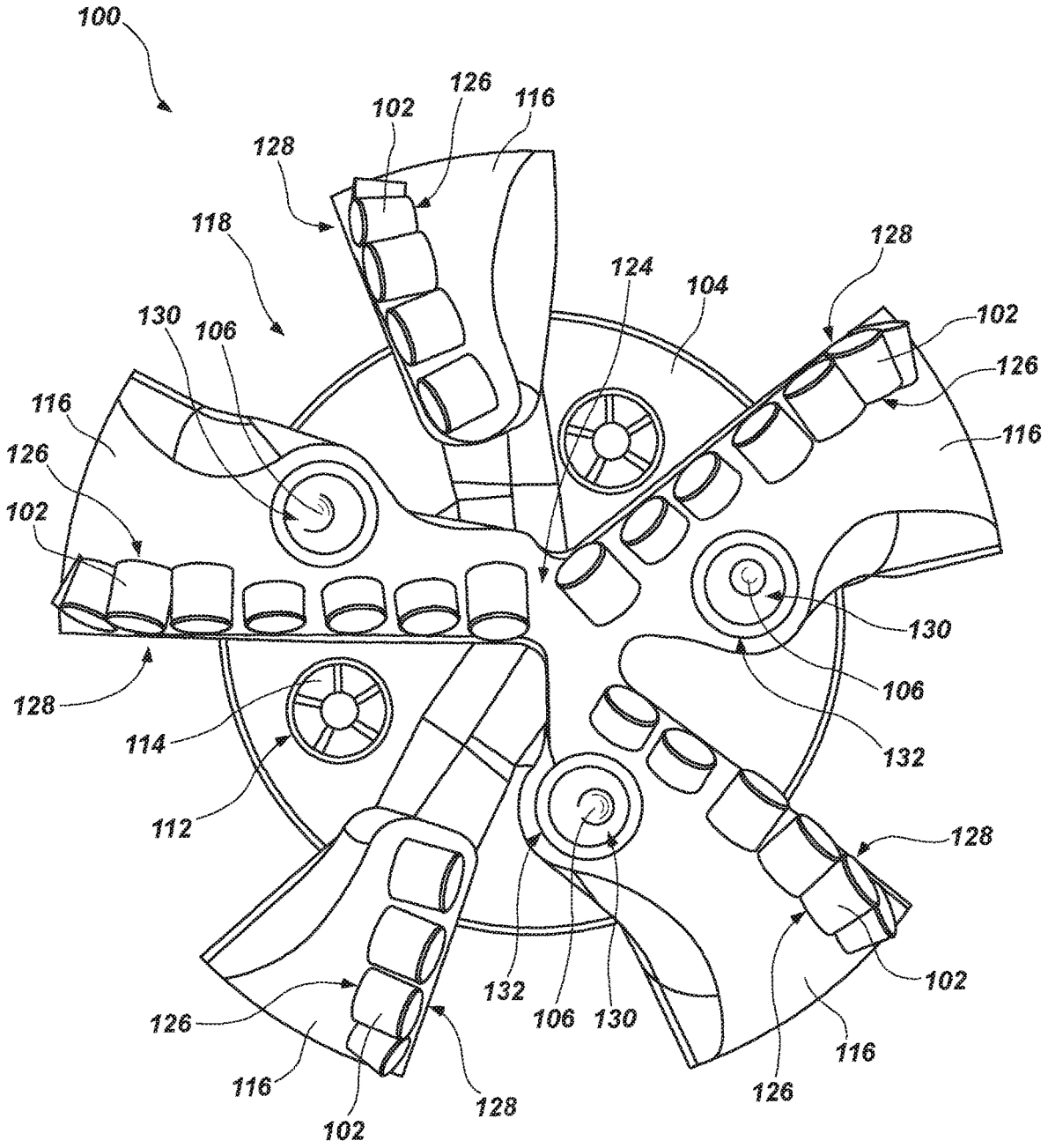
FIG. 2 is a plan view of a cutting face of the earth-boring tool of FIG. 1.

Referring to FIG. 2, a plan view of a face 124 of the earth-boring tool 100 of FIG. 1 is shown. The cutting elements 102 (which may include, for example, PDC cutting elements) may be positioned along the face 124 at a leading end of the body 104. The cutting elements 102 may be positioned at fixed, immovable locations across the face 124. For example, the cutting elements 102 may be rendered immobile by securing them in cutting element pockets 126 formed in each of the blades 116, such as, for example, by brazing. The cutting elements 102 may be located at a rotationally leading edge 128 of each blade 116.

Each movable formation-engaging structure 106 may be attached to a blade 116. In some embodiments, the movable formation-engaging structures 106 may be attached to each primary blade 116 of the earth-boring tool 100. Each formation-engaging structure 106 may rotationally trail at least one cutting element 102 secured to the same blade 116. The formation-engaging structures 106 may be mounted to support members 130, which may be at least partially located within recesses 132 formed in the body 104 of the earth-boring tool 100. The support members 130 may secure the formation-engaging structures 106 to the blades 116 and enable the formation-engaging structures 106 to move relative to the blades 116.

Figure 3:
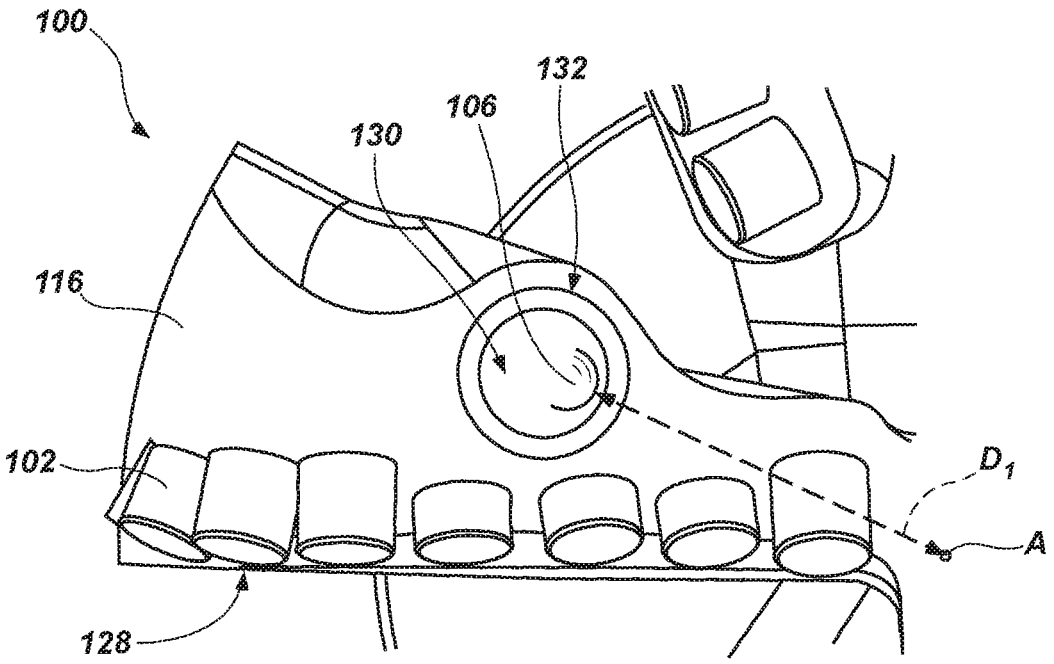
FIG. 3 is an enlarged view of a portion of the earth-boring tool of FIGS. 1 and 2 and illustrates a movable formation-engaging structure of the tool in a first position.

Referring to FIG. 3, an enlarged view of a portion of the earth-boring tool 100 of FIGS. 1 and 2 illustrating a movable formation-engaging structure 106 of the tool 100 in a first position is shown. In some embodiments, such as that shown in FIGS. 3 and 4, the formation-engaging structure 106 may comprise a bearing element (e.g., a bump, knot, post, or other protrusion configured to bear against and ride on an underlying earth formation). When the formation-engaging structure 106 is in the first position, it may be located at a first radial distance $D_1$ from a longitudinal axis A (e.g., an axis of rotation) of the body 104. For example, the formation-engaging structure 106 may be at least partially shielded from directly engaging with an underlying earth formation. As used herein, being shielded or obstructed from directly engaging with an underlying earth formation means that a structure does not remove, or removes to a lesser extent, material from an earth formation by cutting action (e.g., shearing). More specifically, the formation-engaging structure 106 may be at least partially located behind and not exposed above a rotationally leading cutting element 102 secured to the same blade 116 as the formation-engaging structure 106. As a specific, nonlimiting example, the formation-engaging structure 106 may be completely within a helical path (e.g., a kerf) traversed by a rotationally leading cutting element 102 in the first position. The movable formation-engaging structure 106 may be located in the first position, for example, during a first stage of drilling during which the formation-engaging structure 106 is at least partially obstructed from direct engagement with an earth formation.

Figure 4:
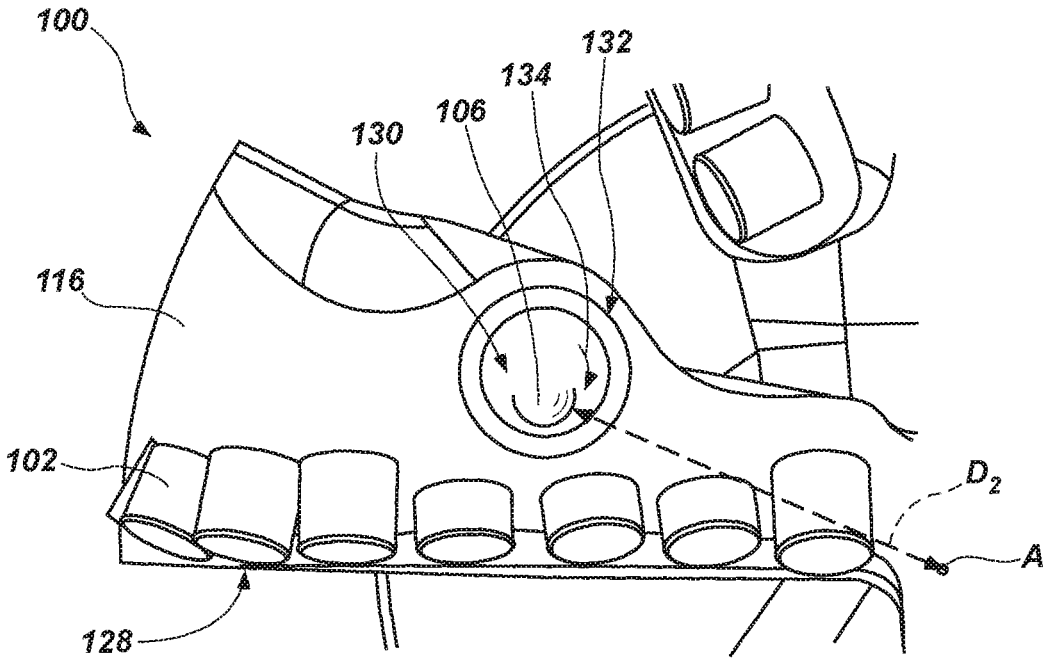
FIG. 4 is similar to FIG. 3, but illustrates the movable formation-engaging structure in a second position.

Referring to FIG. 4, a view similar to FIG. 3 illustrating the movable formation-engaging structure 106 in a second position is shown. When the formation-engaging structure 106 is in the second position, it may be located at a second, different radial distance $D_2$ from the longitudinal axis A of the body 104. For example, the formation-engaging structure 106 may move closer to or farther away from the longitudinal axis A of the body 104 when moving from the first position to the second position. In some embodiments, the formation-engaging structure 106 may rotate (e.g., clockwise or counterclockwise) as it moves from the first position to the second position. For example, in the embodiment shown in FIG. 4, the formation-engaging structure 106 and the support member 130 to which it is mounted may rotate in a clockwise direction, as indicated by arrow 134, relative to the body 104 to move the formation-engaging structure 106 from the first position to the second position. Because of the rotational movement, forces that act on the formation-engaging structure 106 may be more effectively transferred to the blade 116, as compared to formation-engaging structures that may move longitudinally (e.g., may pop up). The formation-engaging structure 106 may be exposed to a greater extent to directly engage with an underlying earth formation when the formation-engaging structure 106 is in the second position. More specifically, a greater proportion of the formation-engaging structure 106 may be exposed at a side of a rotationally leading cutting element 102 secured to the same blade 116 as the formation-engaging structure 106. As a specific, nonlimiting example, the formation-engaging structure 106 may completely occupy a space between helical paths (e.g., kerfs) traversed by adjacent rotationally leading cutting elements 102 in the second position. The movable formation-engaging structure 106 may be located in the second position, for example, during a second stage of drilling, subsequent the first stage of drilling, during which the formation-engaging structure 106 directly engages with an earth formation to a greater extent than it did during the first stage.

In some embodiments, the movable formation-engaging structure 106 may only be movable between the two extreme end positions. In other embodiments, the movable formation-engaging structure 106 may be further movable to, and at least temporarily maintained in, additional, intermediate positions. For example, the movable formation-engaging structure 106 may temporarily stop at a third position (and any additional intermediate positions, such as, for example, fourth, fifth, etc.) between the first and second positions before the movable formation-engaging structure 106 moves to the second position or the movable formation-engaging structure 106 may be temporarily maintained at the second position and then move to a third position between the first and second positions. More specifically, the movable formation-engaging structure 106 may be movable to, and temporarily or permanently maintainable at, a slightly exposed third position before or after it has moved to the second, more exposed position.

Figure 5:
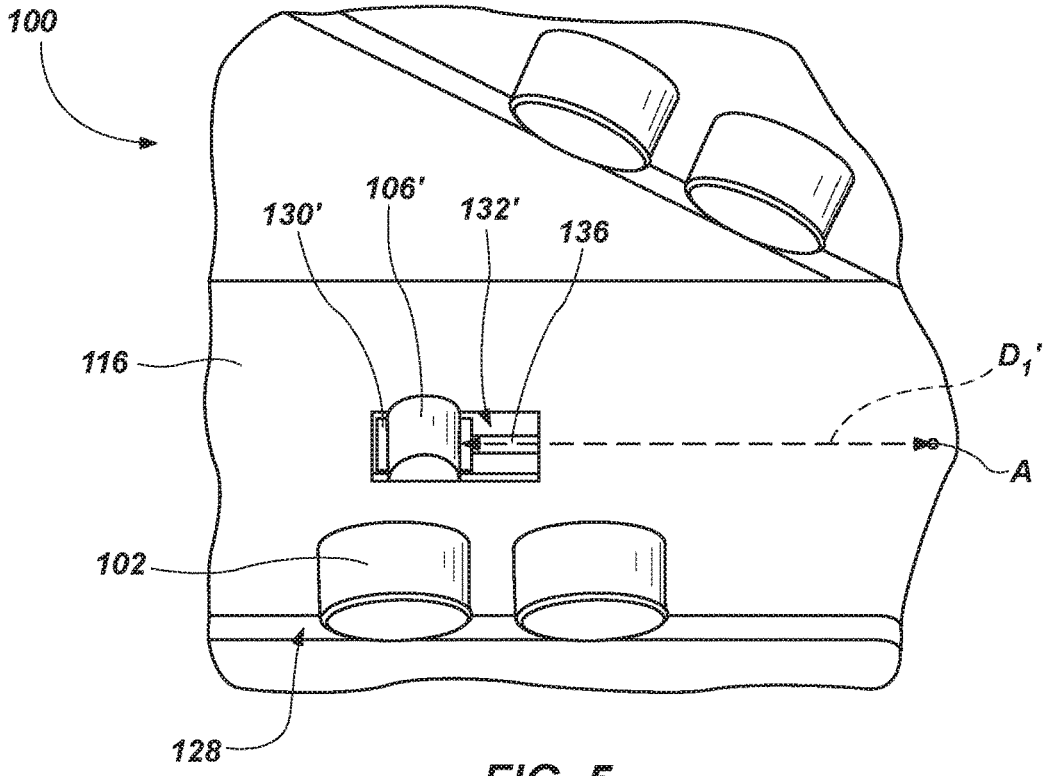
FIG. 5 is an enlarged view of a portion of an earth-boring tool illustrating another embodiment of a formation-engaging structure in a first position.

Referring to FIG. 5, an enlarged view of a portion of an earth-boring tool 100 illustrating another embodiment of a formation-engaging structure 106' in a first position is shown. In some embodiments, such as that shown in FIGS. 5 and 6, the formation-engaging structure 106' may comprise an additional cutting element (e.g., a backup cutting element or an additional primary cutting element). When the formation-engaging structure 106' is in the first position, it may be located at a first radial distance $D_1'$ from a longitudinal axis A (e.g., an axis of rotation) of the body 104. For example, the formation-engaging structure 106' may be at least partially shielded (e.g., completely shielded) from directly engaging with an underlying earth formation in the first position. More specifically, the formation-engaging structure 106' may be at least partially located behind and not exposed above a rotationally leading cutting element 102 secured to the same blade 116 as the formation-engaging structure 106'. As a specific, nonlimiting example, the formation-engaging structure 106' may be completely within a helical path (e.g., a kerf) traversed by a rotationally leading cutting element 102 in the first position.

Figure 6:
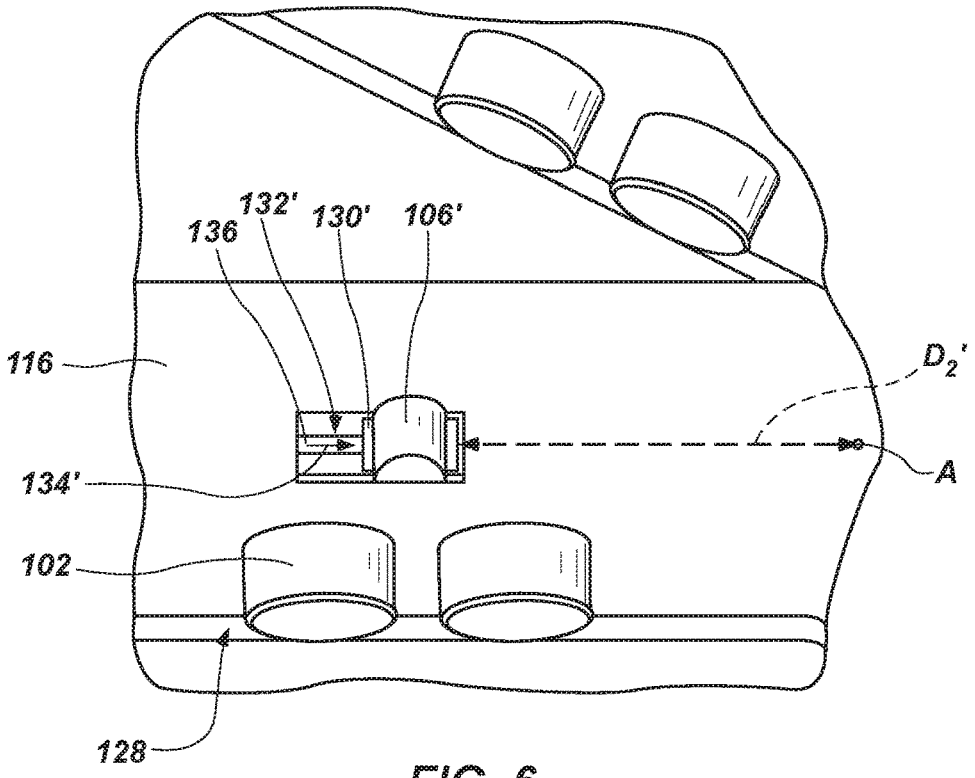
FIG. 6 is similar to FIG. 5, but illustrates the formation-engaging structure in a second position.

Referring to FIG. 6, a view similar to FIG. 5 illustrating the formation-engaging structure 106' in a second position is shown. When the formation-engaging structure 106' is in the second position, it may be located at a second, different radial distance $D_2'$ from the longitudinal axis A of the body 104. For example, the formation-engaging structure 106' may move closer to or farther away from the longitudinal axis A of the body 104 when moving from the first position to the second position. In some embodiments, the formation-engaging structure 106' may translate linearly as it moves from the first position to the second position. For example, in the embodiment shown in FIG. 6, the formation-engaging structure 106' and the support member 130' to which it is mounted may move linearly on tracks 136 within the recess 132', as indicated by arrow 134', relative to the body 104 to move the formation-engaging structure 106' from the first position to the second position.

In some embodiments, the formation-engaging structure 106' may be exposed to a greater extent to directly engage with an underlying earth formation when the formation-engaging structure 106' is in the second position. For example, a greater proportion of the formation-engaging structure 106' may be exposed at a side of a rotationally leading cutting element 102 secured to the same blade 116 as the formation-engaging structure 106'. As a specific, nonlimiting example, the formation-engaging structure 106' may become an additional primary cutting element by moving to occupy a space (e.g., some of the space, a majority of the space, or all of the space) between helical paths (e.g., kerfs) traversed by adjacent rotationally leading cutting elements 102 in the second position. In some embodiments, the formation-engaging structure 106' may render a rotationally following cutting element 102 on another blade 116 a backup cutting element to the formation-engaging structure 106' when the formation-engaging structure 106' moves to the second position and becomes an additional primary cutting element. As another specific, nonlimiting example, the formation-engaging structure 106' may become a backup cutting element with respect to a rotationally leading cutting element 102 on the same blade 116 or on another blade 116 by moving into (e.g., exactly aligned with or underexposed with respect to) a helical path (e.g., a kerf) traversed by the rotationally leading cutting element 102.

Although FIGS. 5 and 6 depict the formation-engaging structure 106' as moving a distance approximately equal to a diameter of the formation-engaging structure 106', the formation-engaging structure 106' may move smaller distances when transitioning from the first position to the second position. For example, a difference between the first radial distance $D_1'$ and the second radial distance $D_2'$ may be between about 0.1% and about 100%, between about 1% and about 25%, or between about 2% and about 5% of the diameter of the formation-engaging structure 106'. As specific, nonlimiting examples, the difference between the first radial distance $D_1'$ and the second radial distance $D_2'$ may be about 0.1 in (2.54 mm) or less, about 0.05 in (1.27 mm) or less, or even about 0.01 in (0.254 mm) or less.

Figure 7:
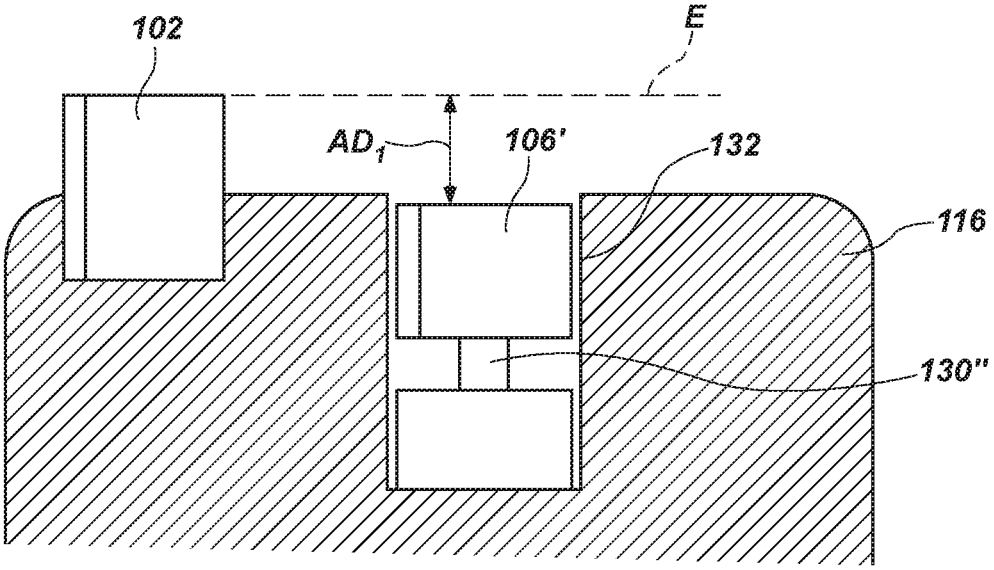
FIG. 7 is a partial cutaway side view of a blade of an earth-boring tool illustrating another embodiment of a formation-engaging structure in a first position.

Referring to FIG. 7, a partial cutaway side view of a blade 116 of an earth-boring tool 100 (see FIG. 1) illustrating another embodiment of a formation-engaging structure 106' in a first position. The formation-engaging structure 106' may comprise, for example, an additional cutting element (e.g., a backup cutting element or an additional primary cutting element). When the formation-engaging structure 106' is in the first position, it may be located at a first axial distance $AD_1$ from an exposure E (e.g., a line extending from a most exposed point, sometime referred to as a "cutting point") of a rotationally leading cutting element 102 secured to the same blade 116. For example, the formation-engaging structure 106' may be at least partially below (e.g., completely below) an upper surface of the blade 116 in the first position. More specifically, the formation-engaging structure 106' may be at least partially located behind a rotationally leading cutting element 102 secured to the same blade 116 as the formation-engaging structure 106' and at least partially within a recess 132 formed in the blade 116. As a specific, nonlimiting example, the formation-engaging structure 106' may be completely within a helical path (e.g., a kerf) traversed by a rotationally leading cutting element 102 and completely within the recess 132 in the first position.

Figure 8:
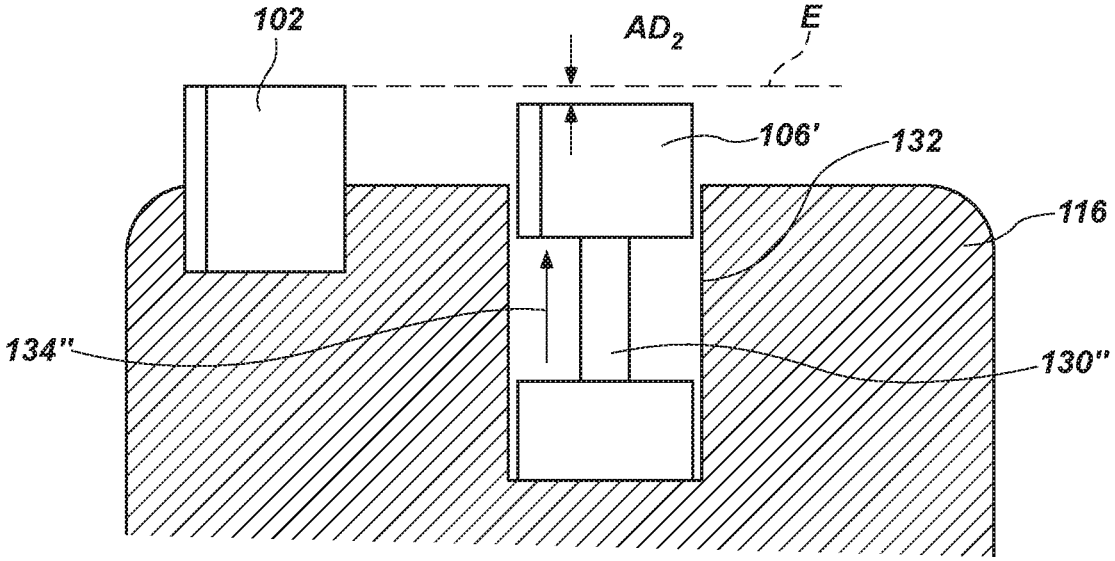
FIG. 8 is similar to FIG. 7, but illustrates the formation-engaging structure in a second position.

Referring to FIG. 8, a view similar to FIG. 7 illustrating the formation-engaging structure 106' in a second position is shown. When the formation-engaging structure 106' is in the second position, it may be located at a second, different axial distance $AD_2$ from the exposure E of the rotationally leading cutting element 102. More specifically, the formation-engaging structure 106' may move closer to the exposure E of the rotationally leading cutting element 102 when moving from the first position to the second position. In some embodiments, the formation-engaging structure 106' may translate linearly as it moves from the first position to the second position. For example, in the embodiment shown in FIG. 8, the formation-engaging structure 106' and the support member 130" to which it is mounted may move axially within the recess 132, as indicated by arrow 134", relative to the rotationally leading cutting element 102 to move the formation-engaging structure 106' from the first position to the second position.

In some embodiments, the formation-engaging structure 106' may be exposed to a greater extent, but may not directly engage with an underlying earth formation when the formation-engaging structure 106' is in the second position. For example, a greater proportion of the formation-engaging structure 106' may be exposed above the upper surface of the blade 116, but the formation-engaging structure 106' may remain underexposed with respect to a rotationally leading cutting element 102 secured to the same blade 116 as the formation-engaging structure 106'. As a specific, nonlimiting example, the formation-engaging structure 106' may become a backup cutting element by moving to occupy a portion of a helical path (e.g., kerf) traversed by a rotationally leading cutting element 102 without extending beyond the rotationally leading cutting element 102 in the second position.

In other embodiments, the formation-engaging structure 106' may directly engage with an underlying earth formation when the formation engaging structure 106' is in the second position. For example, the formation-engaging structure 106' may be laterally offset from the cutting element 102 such that raising the formation-engaging structure 106' exposes the formation-engaging structure 106' at a side of the cutting element 102. As another example, the formation-engaging structure 106' may directly rotationally follow the cutting element 102 such that raising the formation-engaging structure 106' causes the formation-engaging structure 106' to replace the cutting element 102 as a primary cutting element (e.g., at the same original exposure E of the cutting element 102 or at a greater exposure E than the original exposure E of the cutting element 102). The formation-engaging structure 106' may be moved from the first position to the second position in such an example embodiment when the cutting element 102 has become dull, for example.

Although FIGS. 7 and 8 depict the formation-engaging structure 106' as moving a distance approximately equal to one-half of a diameter of the formation-engaging structure 106', the formation-engaging structure 106' may move smaller distances when transitioning from the first position to the second position. For example, a difference between the first axial distance $AD_1$ and the second axial distance $AD_2$ may be between about 0.1% and about 100%, between about 1% and about 25%, or between about 2% and about 5% of the diameter of the formation-engaging structure 106'. As specific, nonlimiting examples, the difference between the first axial distance $AD_1$ and the second axial distance $AD_2$ may be about 0.1 in (2.54 mm) or less, about 0.05 in (1.27 mm) or less, or even about 0.01 in (0.254 mm) or less.

Figure 9:
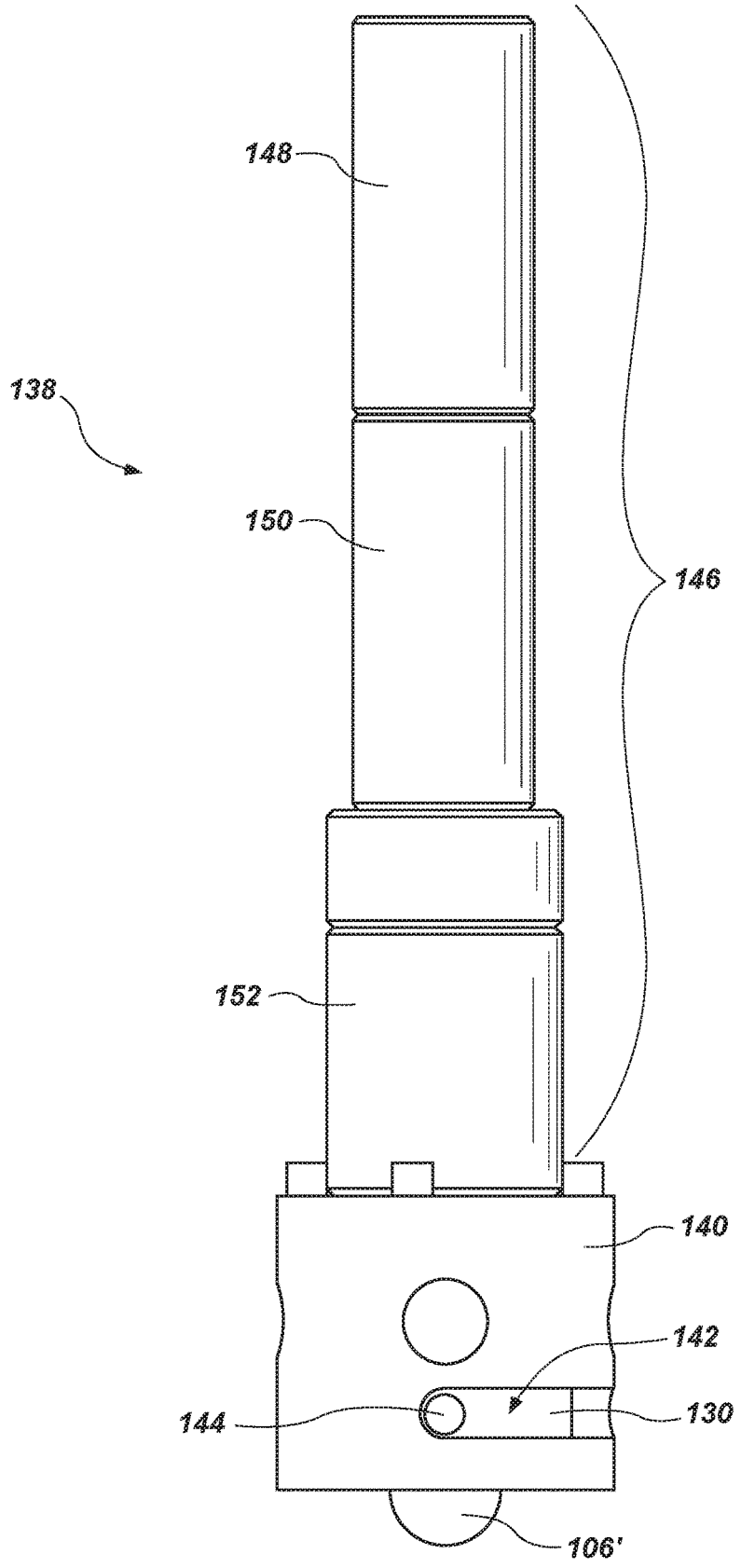
FIG. 9 is a side view of a support member to which a movable formation-engaging structure is mounted and which may be used to connect the formation engaging structure to an earth-boring tool.

Referring to FIG. 9, a side view of a support member 130 to which a movable formation-engaging structure 106' is mounted and which may be used to connect the formation-engaging structure 106' to an earth-boring tool 100 (see FIGS. 1, 2) is shown. In embodiments where the formation-engaging structure 106' comprises an additional cutting element (e.g., a backup cutting element), the formation-engaging structure 106' may be configured to rotate to move from the first position (see FIG. 3) to the second position (see FIG. 4). The support member 130 may be generally cylindrical in shape and may rotate about its longitudinal axis (e.g., central axis) relative to the body 104 (see FIGS. 1, 2) to move the formation-engaging structure 106 from the first position to the second position.

The support member 130 may be a component of an actuation device 138 configured to be secured within a recess 132 (see FIG. 2) extending into a body 104 (see FIG. 2) of an earth-boring tool 100 (see FIG. 2). For example, the support member 130 may be located within a housing 140 configured to be secured to walls defining the recess 132 (see FIG. 2), such as, for example, by brazing. The support member 130 may rotate within the housing 140 to move the formation-engaging structure 106' from the first position to the second position. The housing 140 may include, for example, a guide slot 142 within which a guidepost 144 extending from the support member 130 may be located. As the support member 130 rotates, mechanical interference between the guidepost 144 and the walls defining the guide slot 142 may maintain the support member 130 within the housing 140 and may define the location of the first and second positions. For example, the guidepost 144 may be located at a first radial extent of the guide slot 142, as shown in FIG. 9, when the formation-engaging structure 106' is in the first position.

The actuation device 138 may be configured to automatically move the formation-engaging structure 106' in response to a predetermined event (e.g., a signal, a change in drilling conditions, etc.). For example, the actuation device 138 may include an actuation module 146, which may be, for example, an electro-mechanical or an electro-hydraulic device. More specifically, the actuation module 146 may include a battery 148 configured to power the actuation module 146. The actuation module 146 may further include a receiver 150 configured to detect the predetermined event. For example, the receiver 150 may comprise a mud-pulse telemetry receiver configured to detect pulse patterns in drilling fluid flow, an accelerometer configured to detect changes in rotational speed or patterns of changes in rotational speed of the earth-boring tool 100 (see FIG. 1), or a flow meter configured to detect changes in flow rate of drilling fluid. The receiver 150 may be configured to send power from the battery 148 to a motor 152 (e.g., an electric motor or a hydraulic motor), which may be connected to the support member 130 to rotate the support member 130. As another example, the actuation module 146 may include a flywheel configured to rotate in response to drilling fluid flow and a brake configured to prevent the flywheel from rotating when the pressure of the drilling fluid is below a threshold amount. When the pressure exceeds the threshold amount, the flywheel may rotate, causing the support member 130 to rotate. When the predetermined event occurs, the actuation module 146 may cause the formation-engaging structure 106' to move from the first position to the second position (see FIGS. 10, 11).

Figure 10:
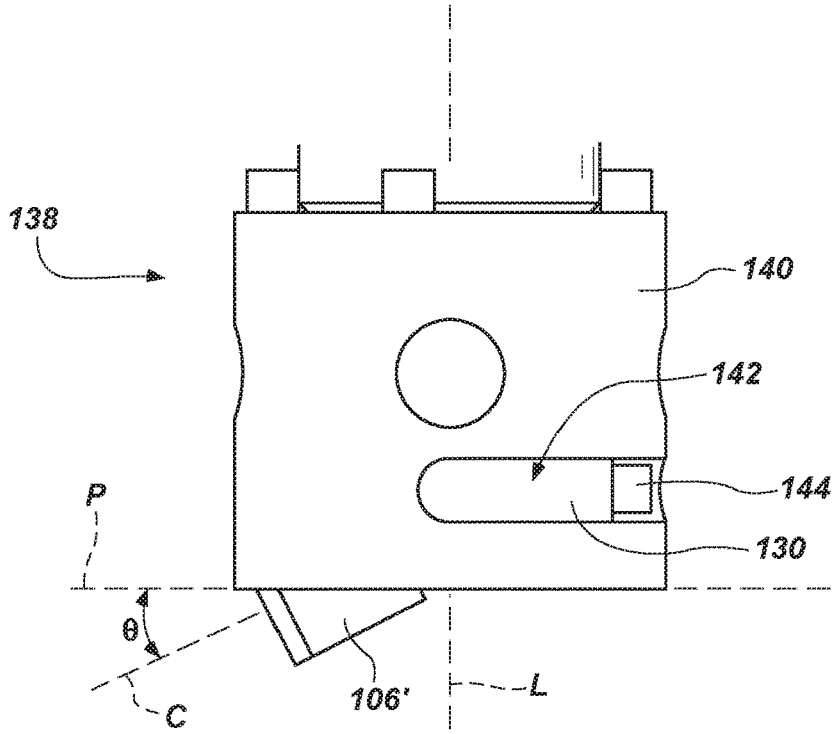
FIG. 10 is an enlarged side view of the support member and movable formation-engaging structure of FIG. 9 illustrating the movable-formation engaging structure in a second position.

Referring to FIG. 10, an enlarged side view of the support member 130 and movable formation-engaging structure 106' of FIG. 9 illustrating the movable-formation engaging structure 106' in a second position is shown. When the support member 130 rotates to move the formation-engaging structure 106' to the second position, the guidepost 144 may move to a second, opposing radial extent of the guide slot 142. In some embodiments, such as those shown in FIGS. 9 through 11, the support member 130 may rotate in a counterclockwise direction to move the formation-engaging structure 106' from the first position (see FIG. 9) to the second position. The formation-engaging structure 106' may be mounted on a longitudinal end of the support member 130 at a location offset from a longitudinal axis L of the support member 130, which may enable the radial distance $D_1$ and $D_2$ of the formation-engaging structure 106' from the longitudinal axis A (see FIGS. 3 through 5) to change in response to rotation of the support member 130. A central axis C of the formation-engaging structure 106' may be oriented at an oblique angle θ (e.g., an acute angle) relative to a plane of rotation P of the formation-engaging structure 106'. In other words, the formation-engaging structure 106' may be oriented at a negative back rake in some embodiments.

Figure 11:
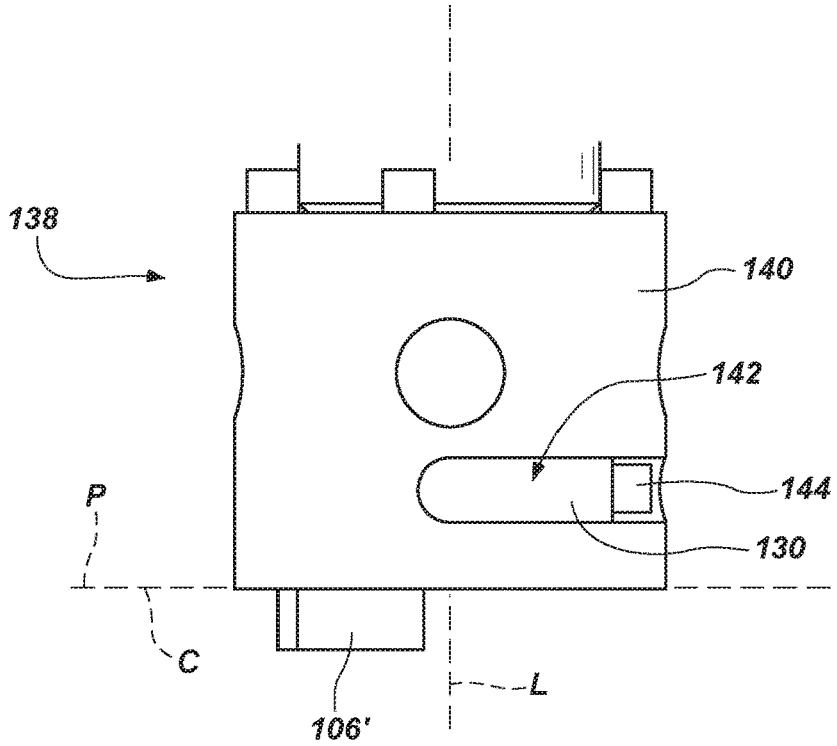
FIG. 11 is an enlarged side view of another embodiment of a movable formation-engaging structure in a second position and mounted to the support member of FIG. 9.

Referring to FIG. 11, an enlarged side view of another embodiment of a movable formation-engaging structure 106' in a second position and mounted to the support member 130 of FIG. 9 is shown. The central axis C of the formation-engaging structure 106' may be in a common plane with the plane of rotation P of the formation-engaging structure 106'. In other words, the formation-engaging structure 106' may be oriented at a neutral back rake (i.e., zero back rake) in some embodiments.

Figure 12:
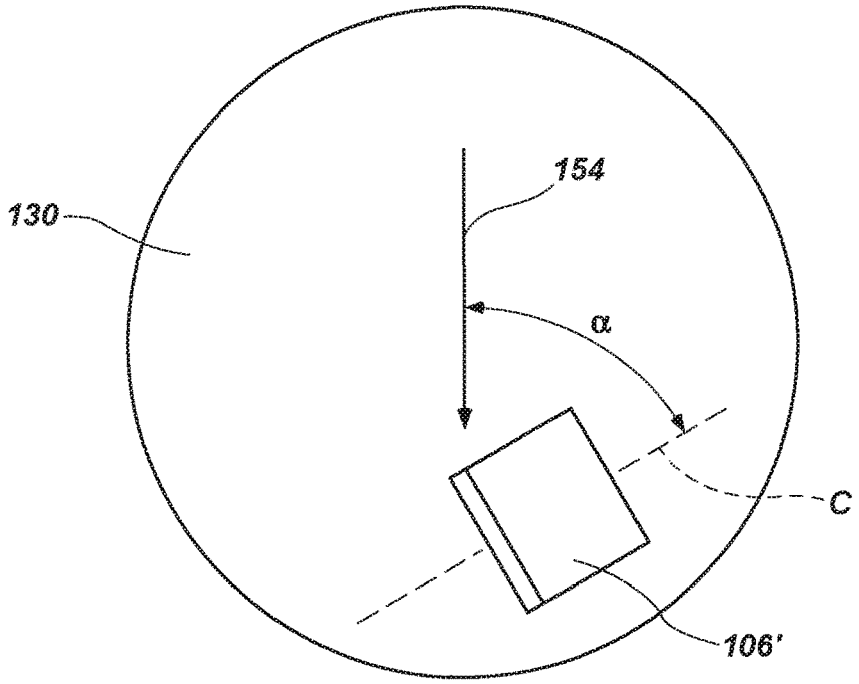
FIG. 12 is an enlarged plan view of a support member to which a movable formation-engaging structure is mounted illustrating the formation-engaging structure in a first position.

Referring to FIG. 12, an enlarged plan view of a support member 130 to which a movable formation-engaging structure 106' is mounted illustrating the formation-engaging structure 106' in a first position is shown. When an earth-boring tool 100 (see FIG. 1) to which the formation-engaging structure 106' is secured rotates within a wellbore, the formation engaging structure 106' may move. A direction of movement of the formation-engaging structure 106' is indicated by arrow 154. When the formation-engaging structure 106' is in the first position, the central axis C of the formation-engaging structure 106' may be oriented at an angle α with respect to the direction of movement 154 of the formation-engaging structure 106'. The angle α may be, for example, a right angle, an oblique angle, or an acute angle. More specifically, the central axis C of the formation-engaging structure 106' may be located in a plane oriented at an acute angle α to the direction of movement 154 of the formation-engaging structure 106' relative to a formation when the formation-engaging structure 106' is in the first position and the earth-boring tool 100 (see FIG. 1) is used to cut a bore in the formation.

Figure 13:
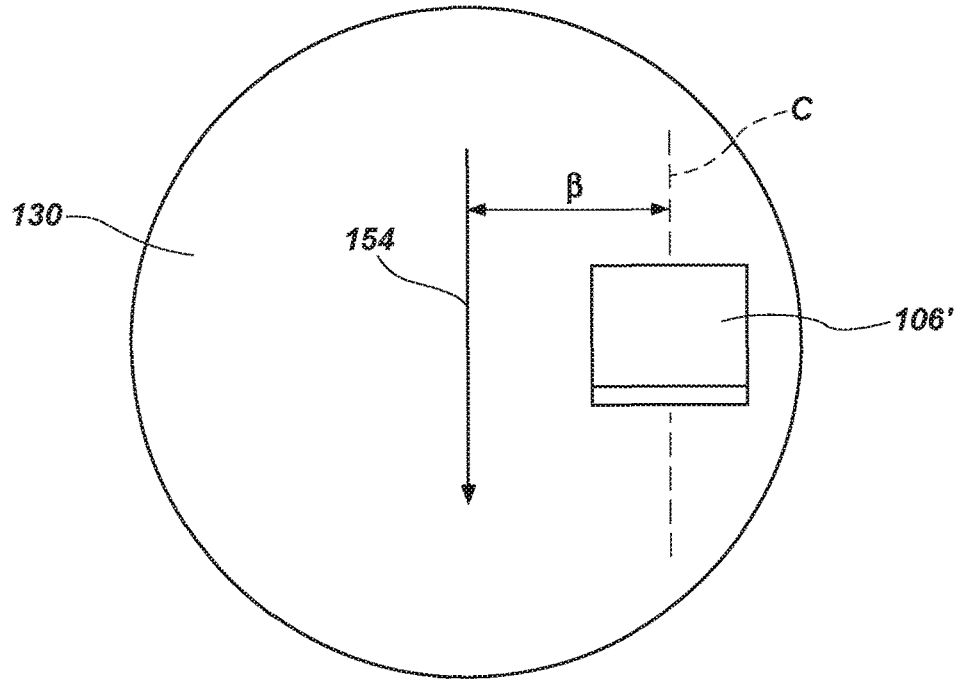
FIG. 13 is similar to FIG. 12, but illustrates the formation-engaging structure in a second position.

Referring to FIG. 13, a view similar to FIG. 12 illustrating the formation-engaging structure 106' in a second position is shown. When the formation-engaging structure is in the second position, the central axis C of the formation-engaging structure 106' may be oriented at a different angle β with respect to the direction of movement 154 of the formation-engaging structure 106'. The angle β may be, for example, a smaller acute angle or 0°. More specifically, the central axis C of the formation-engaging structure 106' and the direction of movement 154 of the formation-engaging structure 106' relative to a formation may lie in a common plane (e.g., may be parallel to one another) when the formation-engaging structure 106' is in the second position and the earth-boring tool 100 (see FIG. 1) is used to cut a bore in the formation.

Figure 14:
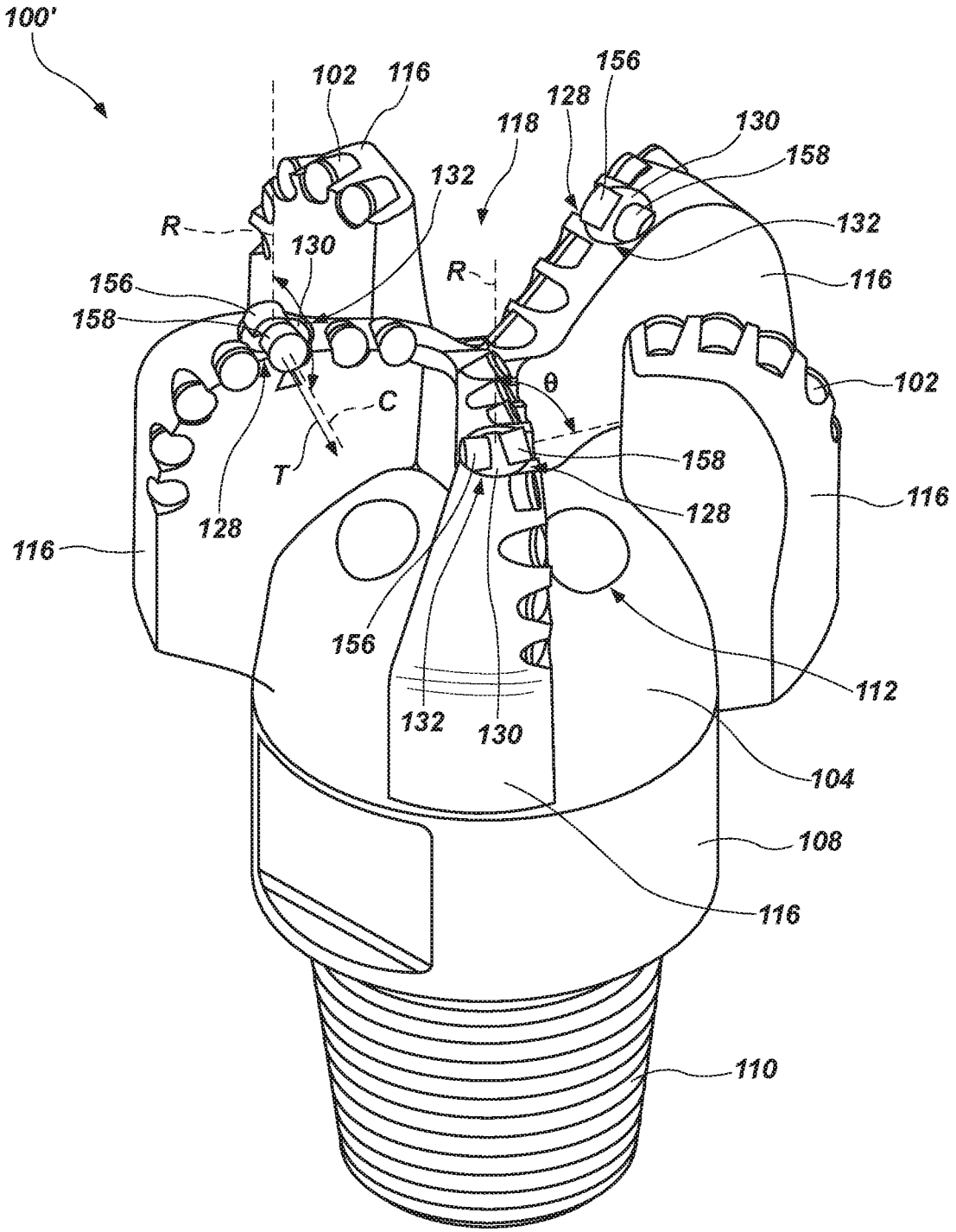
FIG. 14 is a perspective view of another embodiment of an earth-boring tool including a movable replacement cutting element.

Referring to FIG. 14, a perspective view of another embodiment of an earth-boring tool 100' including a movable replacement cutting element 156 is shown. The earth-boring tool 100' may include a support member 130 attached to the body 104 of the earth-boring tool 100'. More specifically, the earth-boring tool 100' may include support members 130 attached to blades 116 extending radially over and longitudinally outward from a remainder of the body 104 within recesses 132 proximate rotationally leading surfaces of the blades 116. In some embodiments, the support members 130 may be attached to each primary blade 116 of the earth-boring tool 100'. Movable cutting elements 158 and movable replacement cutting elements 156 may be attached to respective support members 130. For example, a movable cutting element 158 may be attached to each support member 130 at a first location, and a movable replacement cutting element 156 may be attached to each support member 130 at a second, different location.

Each support member 130 may be configured to move from a first orientation to a second orientation. For example, each support member 130 may be configured to rotate about an axis of rotation R to move from a first orientation, in which the lower left two support members 130 are shown, to a second orientation, in which the upper right support member 130 is shown. As a specific, nonlimiting example, each support member 130 may rotate about 180° to move from the first orientation to the second orientation. The axis of rotation R of a support member 130 may be at least substantially perpendicular to a tangent line T of a rotational path traversed by the movable cutting element 158 attached to the support member 130 when the support member 130 is in the first orientation in some embodiments, as shown in FIG. 14.

When the support member 130 is in the first orientation, the movable cutting element 158 attached to the support member 130 may be located to engage with a formation. For example, the movable cutting element 158 may be located at a rotationally leading edge 128 of the blade 116 when the support member 130 is in the first orientation. The axis of rotation R of the support member 130 may be at least substantially perpendicular to a central axis C of the movable cutting element 158 when the support member 130 is in the first orientation in some embodiments, such as that shown on the leftmost blade 116 of FIG. 14. The axis of rotation R of the support member 130 may be oriented at an oblique angle θ to the central axis C of the movable cutting element 158 when the support member 130 is in the first orientation in other embodiments, such as that shown on the lowermost blade 116 of FIG. 14, because of the rake angle (e.g., back rake) of the movable cutting element 158. The movable replacement cutting element 156 attached to the support member 130 may be located not to engage with the formation when the support member 130 is in the first orientation. For example, the movable replacement cutting element 156 may be located rotationally following the movable cutting element 158 when the support member 130 is in the first orientation. More specifically, the movable replacement cutting element 156 may be located, for example, within a helical rotational path (e.g., kerf) traversed by the movable cutting element 158 such that the movable replacement cutting element 156 does not actively remove formation material when the support member 130 is in the first orientation.

When the support member 130 is in the second orientation, the movable replacement cutting element 156 attached to the support member 130 may be located to engage with the formation. For example, the movable replacement cutting element 156 may be located at the rotationally leading edge 128 of the blade 116 when the support member 130 is in the second orientation. More specifically, the movable replacement cutting element 156 may be located, when the support member 130 is in the second orientation, in the same position (e.g., same exposure, back rake, side rake, etc.) originally occupied by the movable cutting element 158 when the support member 130 was in the first orientation. The movable cutting element 158 attached to the support member 130 may be located not to engage with the formation when the support member 130 is in the second orientation. More specifically, the movable cutting element 158 may be located, for example, within a helical rotational path (e.g., kerf) traversed by the movable replacement cutting element 156 such that the movable cutting element 158 does not actively remove formation material when the support member 130 is in the second orientation. As a specific, nonlimiting example, the movable cutting element 158 may be located, when the support member 130 is in the second orientation, in the same position originally occupied by the movable replacement cutting element 156 when the support member 130 was in the first orientation. Each of the movable cutting element 158 and the movable replacement cutting element 156 may be mounted on an end of the support member 130 at a location offset from the axis of rotation R of the support member 130 to enable the movable cutting element 158 and the movable replacement cutting element 156 to change positions in response to rotation of the support member 130.

In use, the earth-boring tool 100' may be used to drill a first section of a wellbore in a formation with the support members 130 in the first orientation. The movable cutting elements 158 may engage and remove the formation, and the movable replacement cutting elements 156 may not engage or remove the formation because they may be shielded rotationally behind the movable cutting elements 158. The support member 130 may be moved from the first orientation to the second orientation. For example, the support member 130 may be moved from the first orientation to the second orientation after the passage of a fixed amount of time, when instrumentation detects that the movable cutting elements 158 have become dull (e.g., have developed a wear flat), or when the rate of penetration (ROP) of the earth-boring tool 100' falls below a threshold rate. The support member 130 may be moved using any of the actuation devices 138 (see FIGS. 9 through 11) described previously in connection with the formation-engaging structures 106 and 106'. A second section of the wellbore may then be drilled using the earth-boring tool 100' with the support member 130 in the second orientation. The movable replacement cutting elements 156 may engage and remove the formation, and the movable cutting elements 158 may not engage or remove the formation because they may be shielded rotationally behind the movable replacement cutting elements 156.

Figure 15:
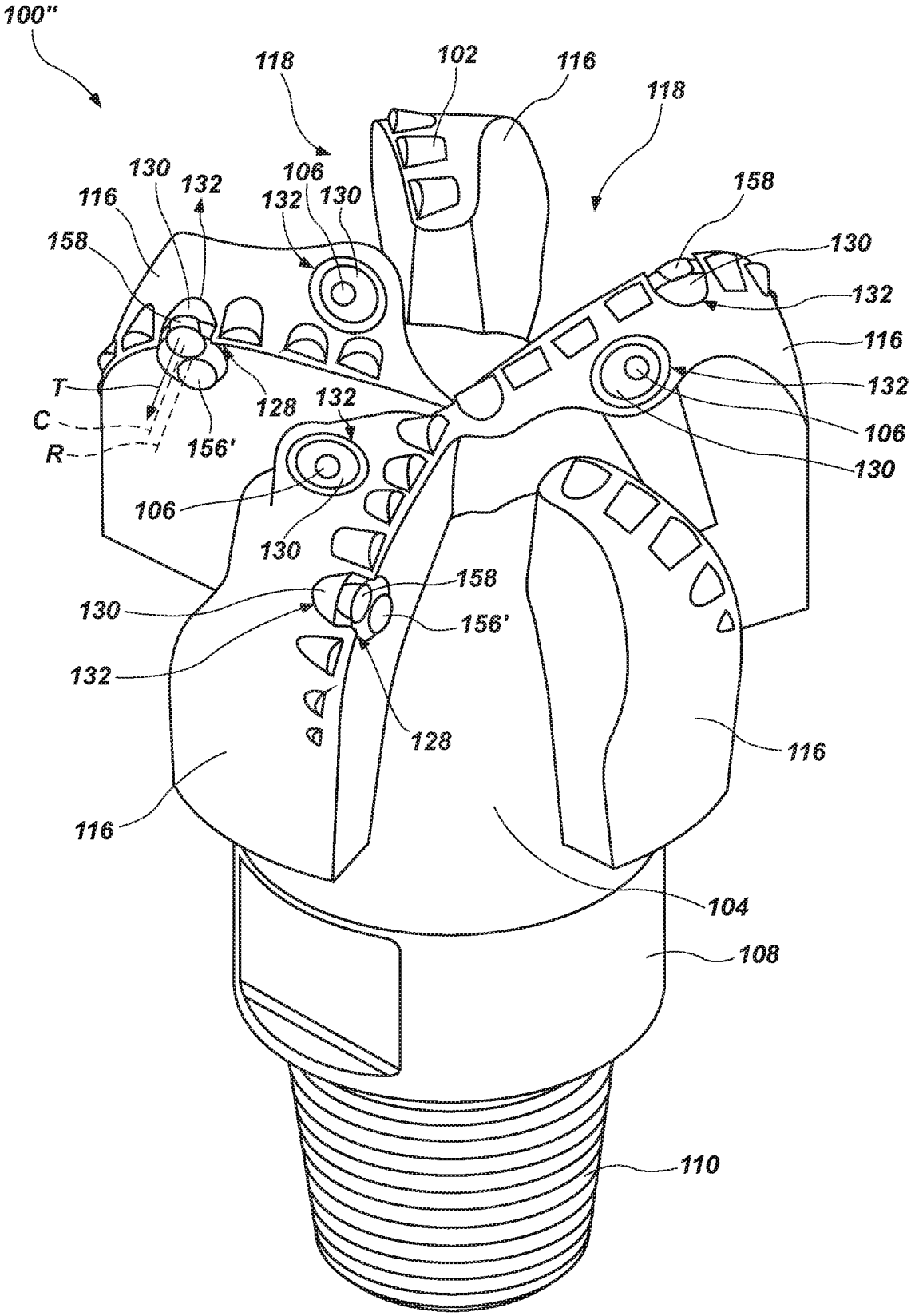
FIG. 15 is a perspective view of another embodiment of an earth-boring tool including another embodiment of a movable replacement cutting element.

Referring to FIG. 15, a perspective view of another embodiment of an earth-boring tool 100" including another embodiment of a movable replacement cutting element 156'. The earth-boring tool 100" may be configured similarly to the earth-boring tool 100' of FIG. 14, but the orientations of the support members 130, movable cutting elements 158, and movable replacement cutting elements 156' may be changed. For example, the axis of rotation R of a support member 130 may be at least substantially parallel to a tangent line T of a rotational path traversed by the movable cutting element 158 attached to the support member 130 when the support member 130 is in the first orientation in some embodiments, as shown in FIG. 15. In such embodiments, the axis of rotation R of the support member 130 may be at least substantially parallel to the central axis C of the movable cutting element 158 attached to the support member 130 when the support member 130 is in the first orientation. In some embodiments, earth-boring tools 100" may include at least one support member 130 to which a formation-engaging structure 106 or 106' as described previously herein is attached and at least another support member 130 to which a movable cutting element 158 and a movable replacement cutting element 156' as described previously herein are attached. For example, each of the primary blades 116 may include one support member 130 to which a formation-engaging structure 106 or 106' as described previously herein is attached and another support member 130 to which a movable cutting element 158 and a movable replacement cutting element 156' as described previously herein are attached.

Additional nonlimiting example embodiments of the disclosure are set forth below.

Embodiment 1

An earth-boring tool, comprising: a body; a cutting element attached to the body at a first location; and a formation-engaging structure attached to the body at a second location, the formation-engaging structure being movable during a drilling operation between a first position and a second position, the formation-engaging structure located rotationally behind the cutting element at a first radial distance from a longitudinal axis of the body at which the cutting element will at least initially shield the formation-engaging structure from engaging a formation when the formation-engaging structure is in the first position, the formation-engaging structure located at a different second radial distance from the longitudinal axis of the body at which the formation-engaging structure will engage a formation when the formation-engaging structure is in the second position.

Embodiment 2

The earth-boring tool of Embodiment 1, wherein the cutting element is attached to the body at an immovable fixed location.

Embodiment 3

The earth-boring tool of Embodiment 2, wherein the body comprises a plurality of blades, and wherein the immovable fixed location is at a rotationally leading edge of a blade of the plurality of blades.

Embodiment 4

The earth-boring tool of any one of Embodiments 1 through 3, wherein the formation-engaging structure rotates as the formation-engaging structure moves from the first position to the second position.

Embodiment 5

The earth-boring tool of any one of Embodiments 1 through 4, wherein the formation-engaging structure comprises an additional cutting element.

Embodiment 6

The earth-boring tool of Embodiment 5, wherein a central axis of the additional cutting element is located in a plane oriented at an acute angle to the direction of movement of the additional cutting element relative to a formation when the additional cutting element is in the first position and the earth-boring tool is used to cut a bore in the formation.

Embodiment 7

The earth-boring tool of Embodiment 5 or Embodiment 6, wherein the central axis of the additional cutting element and the direction of movement of the additional cutting element relative to a formation lie in a common plane when the additional cutting element is in the second position and the earth-boring tool is used to cut a bore in the formation.

Embodiment 8

The earth-boring tool of any one of Embodiments 1 through 7, wherein the formation-engaging structure is mounted to a support member, the support member disposed at least partially within a recess in the body.

Embodiment 9

The earth-boring tool of Embodiment 8, wherein the support member is configured to rotate relative to the body to move the formation-engaging structure from the first position to the second position.

Embodiment 10

The earth-boring tool of Embodiment 9, wherein the support member is generally cylindrical, at least a portion of the support member configured to rotate relative to the body about a longitudinal axis of the support member to move the formation-engaging structure from the first position to the second position.

Embodiment 11

The earth-boring tool of Embodiment 10, wherein the formation-engaging structure is mounted on a longitudinal end of the generally cylindrical support member at a location offset from the longitudinal axis of the support member.

Embodiment 12

The earth-boring tool of any one of Embodiments 1 through 11, further comprising an actuation device configured to move the formation-engaging structure from the first position to the second position.

Embodiment 13

The earth-boring tool of Embodiment 12, wherein the actuation device comprises at least one of an electro-mechanical device and an electro-hydraulic device.

Embodiment 14

The earth-boring tool of Embodiment 12 or Embodiment 13, wherein the actuation device is configured to allow a pressure of drilling fluid flowing through the earth-boring tool to move the formation-engaging structure from the first position to the second position.

Embodiment 15

A method comprising manufacturing an earth-boring tool as recited in any one of Embodiments 1 through 14.

Embodiment 16

A method of forming an earth-boring tool, comprising: attaching a cutting element to a body at a first location; and attaching a movable formation-engaging structure to the body at a second location, the movable formation-engaging structure being movable during a drilling operation between a first position and a second position, the formation-engaging structure located rotationally behind the cutting element at a first radial distance from a longitudinal axis of the body at which the cutting element will at least initially shield the formation-engaging structure from engaging a formation, the formation-engaging structure located at a different second radial distance from the longitudinal axis of the body at which the formation-engaging structure will engage a formation.

Embodiment 17

The method of Embodiment 16, further comprising configuring the formation-engaging structure to rotate as the formation-engaging structure moves from the first position to the second position.

Embodiment 18

The method of Embodiment 16 or Embodiment 17, further comprising selecting the formation-engaging structure to comprise an additional cutting element.

Embodiment 19

A method of drilling a wellbore using an earth-boring tool, comprising: drilling a first section of a wellbore in a formation using an earth-boring tool including a cutting element attached to a body of the earth-boring tool at a first location and a movable formation-engaging structure attached to the body at a second location while the movable formation-engaging structure is in a first position in which the formation-engaging structure is located rotationally behind the cutting element at a first radial distance from a longitudinal axis of the body and the cutting element at least initially shields the formation-engaging structure from engagement with the formation; moving the formation-engaging structure from the first position to a second position at which the formation-engaging structure is located at a different second radial distance from the longitudinal axis of the body and engages the formation; and drilling a second section of the wellbore in the formation using the earth-boring tool while the formation-engaging structure is in the second position and engages the formation.

Embodiment 20

The method of Embodiment 19, further comprising selecting the formation-engaging structure to comprise an additional cutting element.

Embodiment 21

An earth-boring tool, comprising: a body; a cutting element attached to the body at a first location; and a formation-engaging structure attached to the body at a second location, the formation-engaging structure being movable during a drilling operation between a first position and a second position, the formation-engaging structure located rotationally behind the cutting element at a first axial distance from an exposure of the rotationally leading cutting element at which the formation-engaging structure is at least partially located within a recess extending into the body when the formation-engaging structure is in the first position, the formation-engaging structure located at a smaller second axial distance from the exposure of the cutting element at which the formation-engaging structure is underexposed with respect to the rotationally leading cutting element when the formation-engaging structure is in the second position.

Embodiment 22

An earth-boring tool, comprising: a body; a cutting element attached to the body at a first location; and a formation-engaging structure attached to the body at a second location, the formation-engaging structure being movable during a drilling operation between a first position and a second position, the formation-engaging structure located rotationally behind the cutting element such that the cutting element will at least initially shield the formation-engaging structure from engaging a formation when the formation-engaging structure is in the first position, the formation-engaging structure located to engage a formation when the formation-engaging structure is in the second position.

Embodiment 23

The earth-boring tool of Embodiment 22, wherein the formation-engaging structure is located at a first radial distance from a longitudinal axis of the body when the formation-engaging structure is in the first position and the formation-engaging structure is located at a different second radial distance from the longitudinal axis of the body when the formation-engaging structure is in the second position.

Embodiment 24

The earth-boring tool of Embodiment 22, wherein the formation-engaging structure is located at a first axial distance from an exposure of the cutting element when the formation-engaging structure is in the first position and the formation-engaging structure is located at a different second axial distance from the exposure of the cutting element when the formation-engaging structure is in the second position.

Embodiment 25

An earth-boring tool, comprising: a body; a support member attached to the body, the support member being movable during a drilling operation between a first orientation and a second orientation; a movable cutting element attached to the support member at a first location; and a movable replacement cutting element attached to the support member at a second location, wherein the movable cutting element is located to engage with a formation and the movable replacement cutting element is located not to engage the formation when the support member is in the first orientation, and the movable replacement cutting element is located to engage with a formation and the movable cutting element is located not to engage the formation when the support member is in the second orientation.

Embodiment 26

The earth-boring tool of Embodiment 25, wherein the movable replacement cutting element is located in a same position when the support member is in the second orientation as a position occupied by the movable cutting element when the support member is in the first orientation.

Embodiment 27

The earth-boring tool of Embodiment 26, wherein the body comprises blades, and wherein the position occupied by the movable cutting element when the support member is in the first orientation is at a rotationally leading edge of one of the blades.

Embodiment 28

The earth-boring tool of any one of Embodiments 25 through 27, wherein the support member is configured to rotate as the support member moves from the first orientation to the second orientation.

Embodiment 29

The earth-boring tool of Embodiment 28, wherein the second orientation is about 180° of rotation from the first orientation.

Embodiment 30

The earth-boring tool of Embodiment 28 or Embodiment 29, wherein an axis of rotation of the support member is at least substantially parallel to a tangent line of a rotational path traversed by the movable cutting element when the support member is in the first orientation.

Embodiment 31

The earth-boring tool of Embodiment 28 or Embodiment 29, wherein an axis of rotation of the support member is at least substantially perpendicular to a tangent line of a rotational path traversed by the movable cutting element when the support member is in the first orientation.

Embodiment 32

The earth-boring tool of any one of Embodiments 28 through 30, wherein an axis of rotation of the support member is at least substantially parallel to a central axis of the movable cutting element.

Embodiment 33

The earth-boring tool of any one of Embodiments 28, 29, and 31, wherein an axis of rotation of the support member is at least substantially perpendicular to a central axis of the movable cutting element.

Embodiment 34

The earth-boring tool of any one of Embodiments 28 through 31, wherein an axis of rotation of the support member is oriented at an oblique angle to a central axis of the movable cutting element.

Embodiment 35

The earth-boring tool of any one of Embodiments 28 through 34, wherein each of the movable cutting element and the movable replacement cutting element is mounted on an end of the support member at a location offset from an axis of rotation of the support member.

Embodiment 36

The earth-boring tool of any one of Embodiments 25 through 35, further comprising an actuation device configured to move the support member from the first orientation to the second orientation.

Embodiment 37

The earth-boring tool of Embodiment 36, wherein the actuation device comprises at least one of an electro-mechanical device and an electro-hydraulic device.

Embodiment 38

The earth-boring tool of Embodiment 36, wherein the actuation device is configured to allow a pressure of drilling fluid flowing through the earth-boring tool to move the support member from the first orientation to the second orientation.

Embodiment 39

An earth-boring rotary drill bit, comprising: a body; blades extending radially outward over the body and longitudinally outward from a remainder of the body; fixed cutting elements attached to the blades at rotationally leading edges of the blades; a support member attached to at least one of the blades proximate the rotationally leading edge thereof, wherein the support member is movable between a first orientation and a second orientation; a movable cutting element attached to the support member at a first location; and a movable replacement cutting element attached to the support member at a different second location.

Embodiment 40

The earth-boring rotary drill bit of Embodiment 39, wherein the support member is rotatable between the first orientation and the second orientation and each of the first location and the second location is offset from an axis of rotation of the support member.

Embodiment 41

The earth-boring rotary drill bit of Embodiment 39 or Embodiment 40, wherein the movable replacement cutting element is located in a same position when the support member is in the second orientation as a position occupied by the movable cutting element when the support member is in the first orientation.

Embodiment 42

A method of forming an earth-boring tool, comprising: attaching a support member to a body, the support member comprising a movable cutting element attached to the support member at a first location and a movable replacement cutting element attached to the support member at a second location; and positioning a support member to be movable during a drilling operation between a first orientation and a second orientation, wherein the movable cutting element is located to engage with a formation and the movable replacement cutting element is located not to engage the formation when the support member is in the first orientation, and the movable replacement cutting element is located to engage with a formation and the movable cutting element is located not to engage the formation when the support member is in the second orientation.

Embodiment 43

The method of Embodiment 42, further comprising configuring the support member to rotate as the support member moves from the first orientation to the second orientation.

Embodiment 44

The method of Embodiment 42 or Embodiment 43, wherein positioning the support member to be movable during the drilling operation between the first orientation and the second orientation comprises positioning the support member to locate the movable replacement cutting element in a same position when the support member is in the second orientation as a position occupied by the movable cutting element when the support member is in the first orientation.

Embodiment 45

A method of drilling a wellbore using an earth-boring tool, comprising: drilling a first section of a wellbore in a formation using an earth-boring tool including a support member attached to a body of the earth-boring tool in a first orientation in which a movable cutting element attached to the support member engages the formation and a movable replacement cutting element attached to the support member does not engage the formation; moving the support member from the first orientation to a second orientation in which the movable replacement cutting element is located to engage the formation and the movable cutting element is located not to engage the formation; and drilling a second section of the wellbore in the formation using the earth-boring tool while the support member is in the second orientation and the movable replacement cutting element engages the formation.

Embodiment 46

The method of Embodiment 45, wherein moving the support member from the first orientation to the second orientation comprises rotating the support member.

Embodiment 47

The method of Embodiment 46, wherein rotating the support member comprises rotating the support member about 180°.

Although the foregoing description contains many specifics, these are not to be construed as limiting the scope of the present invention, but merely as providing certain embodiments. Similarly, other embodiments of the disclosure may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. An earth-boring tool, comprising:

a body comprising a plurality of blades;

a cutting element attached to one of the plurality of blades of the body; and a formation-engaging structure attached to the one of the plurality of blades of the body, a height of the cutting element above the one of the plurality of blades being greater than an exposure of the formation-engaging structure, the formation-engaging structure configured to move linearly relative to the body during a drilling operation between a first position and a second position, wherein:

the formation-engaging structure is at least partially within a cutting path traversed by the cutting element mounted on the same blade of the plurality of blades as the formation-engaging structure when the formation-engaging structure is in the first position; and the formation-engaging structure is located adjacent to the cutting path traversed by the cutting element mounted on the same blade of the plurality of blades as the formation-engaging structure when the formation-engaging structure is in the second position.

2. The earth-boring tool of claim 1, wherein the formation-engaging structure is located on the one of the plurality of blades at a first radial distance from a longitudinal axis of the body in the first position and at a second radial distance, different than the first radial distance, from the longitudinal axis of the body in the second position.

3. The earth-boring tool of claim 2, wherein the formation-engaging structure is configured to move closer to the longitudinal axis of the body when moving from the first position to the second position.

4. The earth-boring tool of claim 1, wherein the formation-engaging structure is located at least partially behind the cutting element such that the formation-engaging structure is at least partially shielded from engaging a formation in the first position and the formation-engaging structure is located to engage the formation in the second position.

5. The earth-boring tool of claim 1, further comprising an actuation device located within a recess in the body, the actuation device being configured to move the formation-engaging structure from the first position to the second position.

6. The earth-boring tool of claim 5, wherein the actuation device comprises a housing secured to surfaces defining the recess in the body and a support member located at least partially within the housing.

7. The earth-boring tool of claim 1, further comprising a support member coupled to the formation-engaging structure and tracks located within a recess in the body.

8. The earth-boring tool of claim 7, wherein the support member and the formation-engaging structure are configured to move linearly on the tracks as the formation-engaging structure moves between the first position and the second position.

9. The earth-boring tool of claim 1, wherein a distance traversed by the formation-engaging structure between the first position and the second position is substantially equal to a diameter of the formation-engaging structure.

10. The earth-boring tool of claim 1, wherein the cutting element comprises a primary cutting element and the formation-engaging structure comprises an additional cutting element, the primary cutting element being attached to the body at an immovable fixed location at a rotationally leading edge of the one of the plurality of blades of the body.

11. The earth-boring tool of claim 10, wherein the formation-engaging structure is configured as an additional primary cutting element to a rotationally following cutting element on another one of the plurality of blades when the formation-engaging structure is in the second position.

12. The earth-boring tool of claim 10, wherein a central axis of the additional cutting element and a direction of movement of the additional cutting element relative to a formation lie in a common plane when the additional cutting element is in each of the first position and the second position.

13. The earth-boring tool of claim 1, wherein the formation-engaging structure is completely within the cutting path traversed by the cutting element when the formation-engaging structure is in the first position and the formation-engaging structure is exposed at a side of the cutting element when the formation-engaging structure is in the second position.

14. An earth-boring tool, comprising:

a body comprising a plurality of blades;

a cutting element attached to one of the plurality of blades of the body;

a support member located within a recess in the body; and a formation-engaging structure secured to the one of the plurality of blades of the body with the support member, the formation-engaging structure configured to move linearly relative to the body during a drilling operation between a first position and a second position, the formation-engaging structure being at least partially within a cutting path traversed by the cutting element mounted on the same blade of the plurality of blades as the formation-engaging structure when the formation-engaging structure is in the first position, and the formation-engaging structure being at least partially exposed beyond the cutting path traversed by the cutting element mounted on the same blade of the plurality of blades as the formation-engaging structure when the formation-engaging structure is in the second position, wherein a height of the cutting element above the one of the plurality of blades is greater than an exposure of the formation-engaging structure.

15. The earth-boring tool of claim 14, wherein the cutting element comprises a primary cutting element and the formation-engaging structure comprises an additional cutting element, the formation-engaging structure being configured as a backup cutting element in the second position.

16. The earth-boring tool of claim 14, wherein a distance traversed by the formation-engaging structure between the first position and the second position is between about 1 percent and about 25 percent of a diameter of the formation-engaging structure.

17. The earth-boring tool of claim 14, wherein each of the cutting element and the formation-engaging structure are located on a primary blade of the plurality of blades of the body.

18. The earth-boring tool of claim 14, further comprising an actuation device located within the recess in the body, wherein the support member is a component of the actuation device.

19. The earth-boring tool of claim 18, wherein the actuation device is configured to automatically move the formation-engaging structure from the first position to the second position in response to a predetermined event.

20. The earth-boring tool of claim 19, wherein the actuation device comprises a receiver configured to detect the predetermined event, the receiver comprising at least one of a mud-pulse telemetry receiver or an accelerometer.

* * * * *